US005227283A

United States Patent [19]

Mori

[11] Patent Number: 5,227,283

[45] Date of Patent: Jul. 13, 1993

[54] SILVER HALIDE PHOTOGRAPHIC MATERIAL

[75] Inventor: Hiroyuki Mori, Kanagawa, Japan

[73] Assignee: Fuji Photo Film Co., Ltd., Kanagawa, Japan

[21] Appl. No.: 748,619

[22] Filed: Aug. 22, 1991

[30] Foreign Application Priority Data

Aug. 24, 1990 [JP] Japan ..... 2-223258

[51] Int. Cl.[5] ..... G03C 1/76

[52] U.S. Cl. ..... 430/523; 430/140; 428/694; 252/62.54; 252/62.63; 252/62.58

[58] Field of Search ..... 430/39, 140, 523; 428/694; 252/62.54, 62.63, 62.58

[56] References Cited

U.S. PATENT DOCUMENTS 3,782,947 1/1974 Krall ..... 430/132
4,279,945 7/1981 Audran et al. ..... 430/140
4,302,523 11/1981 Audran et al. ..... 430/140
4,548,801 10/1985 Nagai et al. ..... 252/62.63
4,698,182 10/1987 Nagai et al. ..... 252/62.63
4,699,840 10/1987 Yashiro et al. ..... 252/62.54
4,778,734 10/1988 Ohdan et al. ..... 252/62.59
5,147,768 9/1992 Sakakibara ..... 430/39

FOREIGN PATENT DOCUMENTS 2-58633 10/1990 Japan ..... 252/62.63

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide photographic material is disclosed comprising a support having provided thereon at least one light-sensitive silver halide emulsion and at least one transparent magnetic recording layer, wherein the magnetic recording layer contains a binder and hexagonal platy barium ferrite magnetic particles, and has a degree of gray of at least 70%.

8 Claims, No Drawings

SILVER HALIDE PHOTOGRAPHIC MATERIAL

FIELD OF THE INVENTION

The present invention relates to a silver halide photographic material, and more particularly to a silver halide photographic material having a magnetic recording layer having high transparency to visible light and very excellent magnetic recording characteristics.

BACKGROUND OF THE INVENTION

Hitherto, it has been very difficult to record data (e.g., date on which a photograph is taken, weather, magnification, the number of prints) onto a silver halide photographic material (hereinafter, photographic material) while photographing with a camera. The date on which a photographic was taken could be optically recorded on the light-sensitive emulsion layer of the photographic material. It was very difficult to record onto the photographic material itself during printing. This is a severe disadvantage in a high-speed operation and results in a loss of efficiency.

The recording of various information onto a photographic material is a very important means for enhancement of camera operability and simplification. The use of magnetic recording system as a means for recording information has been studied, because input and output is arbitrarily made, and the system is inexpensive. For example, U.S. Pat. Nos. 3,782,947, 4,279,945 and 4,302,523 disclose a magnetic recording layer is provided on the back side of a photographic material having a transparent support, the magnetic recording layer is provided with the requisite degee of transparency for the photographic materials during photographing with no adverse effection graininess by appropriately selecting the amount of magnetic particles to be contained in the magnetic recording layer. Systems for recording signals onto the magnetic recording layer are disclosed in WO 90-4205 and WO 90-04212.

The recording of various information onto the photographic material (which was conventionally difficult), is made possible by providing magnetic recording layer and an input and output system (e.g., recording and reproduction system). For example, it is now possible to record onto the magnetic layer of the photographic material the date of photographing, weather and illumination conditions, photographing conditions such as reduction/enlargement rate, etc., the number of reprints, places to be zoomed, development of messages, etc. and printing conditions, and to later read the recording information. Furthermore, it is expected that the reproduced information from the photographic material can constitute output signal means to directly form, e.g., TV/video image.

Photographic materials having a transparent magnetic recording layer are disclosed in JP-B-57-6576 (the term "JP-B" as used herein means an "examined Japanese patent publication") and JP-A-53-109604 (thee term "JP-A" as used herein means as "unexamined published Japanese patent application"). Magnetic recording layers containing γ-iron (III) oxide as proposed in these patent specifications have a low transmittance to light in the visible region. Hence, it has been desired to provide a magnetic recording layer having a higher transmittance for use in a photographic material.

Further more, magnetic recording layers containing γ-iron (III) oxide have a low transmittance to light having short wavelengths and high transmittance to light of long wavelengths. Accordingly, optical density of the magnetic recording layer is highly dependent on the wavelength of the light which is photographically undesirable. It has been a need to develop a magnetic recording layer having a constant optical density as a function of incident wavelength, namely, a magnetic recording layer having a transparency near neutral gray.

SUMMARY OF THE INVENTION

Accordingly, an object of the present invention is to provide a silver halide photographic material comprising a magnetic recording layer having excellent magnetic characteristics for recording information relating to photographing and laboratory processing, and which magnetic recording layer is so transparent as to have a transparency that is nearly neutral gray.

The above-described objects of the present invention have been achieved by providing a silver halide photographic material comprising a film support having provided thereon at least one light-sensitive silver halide emulsion layer and at least one transparent magnetic recording layer, wherein the magnetic recording layer contains a binder and hexagonal platy barium ferrite magnetic particles, and the magnetic recording layer has a degree of gray of at least 70%.

DETAILED DESCRIPTION OF THE INVENTION

The present invention is illustrated in more detail below.

The term "transmitted average density" as used herein refers to the average value of blue, green and red filter density values specified by ISO 5/3-1984(E) to visible light in the region of 400 to 700 nm. The transmitted average density of the magnetic recording layer is preferably 0.5 or less. The term "degree of gray of transmitted density" as used herein refers to the ratio (%) of the minimum value to the maximum value among said blue, green and red filter density values. A higher degree of gray is preferable, but is at least 70% in the present invention.

Ferromagnetic powders conventionally are used in a magnetic recording layer. Examples of such powders include fine powders of ferromagnetic iron oxide, fine powders of Co-doped ferromagnetic iron oxide, fine powders of chromium dioxide, ferromagnetic alloy powders and barium ferrite powder.

Hexagonal platy (i.e., plate-like) barium ferrite particles are used as the magnetic substance in the magnetic recording layer of the present invention. Hexagonal platy barium ferrite having a thickness (interval between the two hexagonal faces which a particle has) of from 0.002 to 0.05 μm is preferred. The specific surface area of the Hexagonal platy barium ferrite is preferably from 5 to 50 $m^2/g$.

The easily magnetizable axis of hexagonal platy barium ferrite particle is in the direction perpendicular to the plate. A magnetic recording medium containing barium ferrite is characterized in that even when the applied coercive force is relatively low, the production output in the short recording wavelength region is relatively high, and high-density recording is possible. Accordingly, a magnetic recording medium capable of standing use can be obtained by using a relatively small amount of barium ferrite. Hence, barium ferrite is suitably useds as the magnetic substance for coating the entire surface of the photographic material. Particularly, when barium ferrite is used, the coverage of magnetic substance particles is reduced, and a magnetic recording layer having high transparency to visible light can be obtained using platy particles having a thickness of from 0.002 to 0.05 μm.

Furthermore, the barium ferrite magnetic recording layer of the present invention is characterized in that absorption in the region of visible light is relatively constant, namely, transparency is near neutral gray in comparison with other ferromagnetic substances such as Co-containing iron(III) oxide.

When barium ferrite is used, conventional horizontal recording can be accomplished, and moreover, horizontal recording capable of greatly increased recording density is obtained. Barium ferrite has such merits that when once magnetized, the tendency for magnetization to be reduced in a diamagnetic field, namely, self-diamagnetization is low, and recording is only difficultly erased.

Barium ferrite can be prepared by a glass crystallization method, a hydro-thermal reaction method or a wet co-precipitation method, for example, as described in U.S. Pat. Nos. 4,341,648, 4,493,874, 4,648,801 and 4,752,407.

Hexagonal platy barium ferrite magnetic particles are used as the magnetic substance in the magnetic recording layer of the present invention. The thickness of the hexagonal platy barium ferrite magnetic particles is generally from 0.002 to 0.05 μm, preferably from 0.003 to 0.03 μm, more preferably from 0.005 to 0.02 μm. The particle size of the hexagonal platy barium ferrite particles is preferably from 0.01 to 2.5 μm. The aspect ratio is preferably from 2.5 to 10.

The amount of barium ferrite powder contained in the transparent magnetic recording layer is from $4\times10^{-4}$ to 3 g, preferably $10^{-3}$ to 1 g, more preferably $4\times10^{-3}$ to $4\times10^{-1}$ g per $m^2$ of the support.

Examples of the binder for use in the magnetic recording layer of the present invention include binders used in conventional magnetic recording media, such as thermoplastic resins, thermosetting resins, radiation-curable resins, reactive type resins and mixtures thereof.

The above resins have a Tg of from −40° C. to 150° C., and a weight-average molecular weight of 10,000 to 300,000, preferably from 10,000 to 100,000.

Examples of useful thermoplastic resins include vinyl copolymers such as a vinyl chloride-vinyl acetate copolymer, copolymers of vinyl chloride or vinyl acetate with vinyl alcohol, maleic acid and/or acrylic acid, a vinyl chloride vinylidene chloride copolymer, a vinyl chloride-acrylonitrile copolymer and an ethylene-vinyl acetate copolymer, cellulose derivatives such as nitrocellulose, cellulose acetate propionate and cellulose acetate butyrate, acrylic resins, polyvinyl acetal resins, polyvinyl butyral resins, polyester polyurethane resins, polyether polyurethane resins, polycarbonate polyurethane resins, polyester resins, polyether resins, polyamide resins, amino resins, rubbery resins such as a styrene-butadiene resin and a butadiene-acrylonitrile resin, silicone resins and fluoro resins.

Among them, vinyl chloride resins are preferred because of the high degree of dispersibility therein of the magnetic powder.

The above desired radiation-curable resins are those obtained by bonding a group having a carbon-to-carbon unsaturated bond as a radiation-curable functional group to the above thermoplastic resins. Preferred functional groups include acryloyl group and methacryloyl group.

Resins obtained by introducing a polar group (e.g., epoxy group, $CO_2M$, OH, $NR_2$, $NR_3X$, $SO_3M$, $OSO_3M$, $PO_3M_2$, $OPO_3M_2$ wherein M is hydrogen, an alkali metal or ammonium, and when one polar group has two M groups, they may be the same or different) into the molecules of the above-described binders are preferred for providing dispersibility and durability of the magnetic layer.

The above-described high-molecular weight binders may be used either alone or in combination of two or more, and can be cured by adding a conventional isocyanate crosslinking agent and/or a radiation-curable vinyl monomer.

As the binder, a hydrophilic binder can be also used in the magnetic recording layer of the present invention.

Useful hydrophilic binders such as water-soluble polymers, cellulose esters, latex polymers and water-soluble polyesters are described in *Research Disclosure* No. 17643 (page 26) and ibid. No. 18716 (page 651). Examples of the water-soluble polymers include gelatin, gelatin derivatives, casein, agar-agar, sodium alginate, starch, polyvinyl alcohol, polyacrylic acid copolymers and maleic anhydride copolymers. Examples of the cellulose esters include carboxymethyl cellulose and hydroxyethyl cellulose. Examples of the latex polymers include vinyl chloride copolymers, vinylidene chloride copolymers, acrylic ester copolymers, vinyl acetate copolymers and butadiene copolymers. Among them, gelatin is most preferred.

Examples of usable gelatin include alkali-processed (lime-processed) gelatin which is immersed in an alkaline bath before the extraction of gelatin during the course of the preparation thereof, acid-processed gelatin which is immersed in an acid bath, double-immersed gelatin formed through both treatments, and enzyme-processed gelatin. If desired, colloidal albumin, casein, a cellulose derivative such as carboxymethyl cellulose or hydroxyethyl cellulose, agar-agar, sodium alginate, a starch derivative, a saccharose derivative such as dextran, a synthetic hydrophilic colloid such as polyvinyl alcohol, poly-N-vinylpyrrolidone, a polyacrylic acid copolymer, polyacrylamide or a derivative thereof, a partially hydrolyzate thereof or a gelatin derivative which is a part of the gelatin may be optionally used in combination with gelatin. Preferably, the magnetic recording layer of the present invention containing gelatin is hardened. Examples of useful hardening agents include aldehyde compounds such as formaldehyde and glutaraldehyde; ketone compounds such as diacetyl and cyclopentanedione; bis(2-chloroethylurea); 2-hydroxy-4,6-dicyloro-1,3,5-triazine; reactive halogen-containing compounds as described in U.S. Pat. Nos. 3,288,775 and 2,732,303, U.K. Patents 974,723 and 1,167,207; divinyl sulfone; 5-acetyl-1,3-diacryloylhexahydro-1,3,5-triazine; reactive olefin compounds described in U.S. Pat. Nos. 3,635,718 and 3,232,763, U.K. Patent 994,869; N-hydroxymethylphthalimide; N-methylol compounds as described in U.S. Pat. Nos. 2,732,316 and 2,586,168; isocyanates as described in U.S. Pat. No. 3,103,437; aziridine compounds as described in U.S. Pat. Nos. 3,017,280 and 2,983,611; acid derivatives as described in U.S. Pat. Nos. 2,725,294 and 2,725,295; epoxy compounds as described in U.S. Pat. No. 3,091,537; and halocarboxyaldehydes such as mucochloric acid. Examples of inorganic compounds for use as the hardening agent include chromium alum, zirconium sulfate and the carboxyl group activation type hardening agents described in JP-B-56-12853, JP-B-58-32699, Belgian Patent 825,726, JP-A-60-225148, JP-A-51-126125, JP-B-58-50699, JP-A-52-54427 and U.S. Pat. No. 3,321,313.

The hardening agent is generally used in an amount of from 0.01 to 30% by weight, preferably 0.05 to 20% by weight based on the amount of dry gelatin contained in the same layer.

The magnetic recording layer has a thickness of from 0.1 to 10 μm, preferably from 0.2 to 5 μm, more preferably from 0.5 to 3 μm.

The weight ratio of the magnetic substance to the binder in the magnetic recording layer is preferably from 2:1 to 1:100.

The magnetic recording layer of the present invention is preferably established on the back side of the photographic material (opposite the side of the support having thereon the light-sensitive silver halide layer). The magnetic recording layer can be established on the support by coating or printing. In a preferred embodiment, a transparent support having provided thereon the magnetic recording layer is prepared by co-casting a polymer solution containing magnetized particles dispersed therein, and a polymer solution for forming the transparent support. In this case, it is preferable that the compositions of the polymers are substantially the same.

Known additives may be incorporated into the magnetic recording layer for improving lubricity, controlling curling, imparting antistatic properties and preventing adhesion to other materials. A separate layer distinct from the magnetic recording layer may also be provided to impart any of these functions. If desired, a protective layer adjacent to and covering the magnetic recording layer may be provided to improve scratch resistance. The back of the transparent support having provided thereon the magnetic recording layer may be calendered to improve smoothness, such that the S/N ratio of the magnetic signal is improved. In this case, it is preferred that the light-sensitive layers are coated onto the transparent support after calendering.

Various plastic films can be used as the film support of the present invention without particular limitation. Preferred examples of the support include films of cellulose derivatives (e.g., diacetyl-, triacetyl, propionyl-, butanoyl-, acetylpropionyl-acetate), polyamides, polycarbonates (as described in U.S. Pat. No. 3,023,101), polyesters (particularly, polyethylene terephthalate, poly-1,4-cyclohexanedimethylene terephthalate, polyethylene-1,2-diphenoxyethane-4,4'-dicarboxylate, polybutylene terephthalate, polyethylene naphthenate as described in JP-B-48-40414), polystyrene, polypropylene, polyethylene, polymethylpentene, polysulfone, polyether sulfone, polyarylates, polyetherimides. Among them, triacetylcellulose and polyethylene terephthalate are particularly preferred.

The support can contain a plasticizer to impart flexibility thereto. Particularly, cellulose ester generally contain a plasticizer such as triphenyl phosphate, biphenyl diphenyl phosphate or dimethyl ethyl phosphate.

The thicknesses of the support varies depending on the type of constituent polymers, but the support generally ranges from a sheet of about 1 mm in thickness to a thin film of about 20 μm in thickness depending on the intended appliication. The supports generally used has a thickness of from 50 to 300 μm.

The polymer for use in the formation of the support has a molecular weight of preferably not less than 10,000, more preferably 20,000 to 80,000.

The supports may contain a dye to neutralize the tint of the base, and to prevent light piping and halation.

To firmly bond photographic layers (e.g., light-sensitive silver halide emulsion layers, interlayers, filter layers and the transparent magnetic recording layer of the present invention or electrically conductive layers) onto the support, these supports may be subjected to a surface activation treatment such as a reagent treatment, a mechanical treatment, a corona discharge treatment, a flame treatment, an ultraviolet treatment, a high frequency treatment, a glow discharge treatment, an active plasma treatment, a laser treatment, a mixed acid treatment or an ozone-oxidizing treatment, and then coated directly with a photographic emulsion. Alternatively, an undercoat layer (e.g., subbig layer) may be provided on the support after the surface treatment or without carrying out the surface treatment, and photographic emulsions may then be coated thereon.

When the support is composed of a cellulose derivative, a single layer of a dispersion of gelatin in a mixed solvent of methylene chloride and an alcohol is coated thereon to provide an undercoat layer.

The undercoating solution may contain a hardening agent for gelatin. Examples of the hardening agent include chromium salts (e.g., chromium alum), aldehydes (e.g., formaldehyde, glutaraldehyde), isocyanates, active halogen compounds (e.g., 2,4-dichloro-6-hydroxy-s-triazine) and epichlorohydrin resins. The undercoating resin may optionally contain various additives such as a surfactant, an antistatic agent, an antihalation agent, a coloring dye, pigment, a coating aid and an antifogging agent. The undercoating solution of the present invention can contain an etching agent such as resorcinol, chloral hydrate or chlorophenol.

The underlayer of the present invention may contain fine particles of an inorganic compound such as $SiO_2$or $TiO_2$, or fine particles (particle size: 1 to 10 μm) of polymethyl methacrylate copolymer as a matting agent.

The undercoating solution of the present invention can be coated by well-known coating methods such as a dip coating method, an air knife coating method, a curtain coating method, a roller coating method, a wire bar coating method, a gravure coating method or an extrusion coating method using a hopper as described in U.S. Pat. No. 2,681,294. If desired, two or more layers can be simultaneously coated using methods described in U.S. Pat. Nos. 2,761,791, 3,508,947, 2,941,898 and 3,526,528 and *Coating Engineering*, page 253, written by Yuji Harasaki (published by Asakura Shoten 1973).

The photographic material of the present invention can comprise a silver halide emulsion layers, a back layer, a protective layer, an interlayers, an antihalation layer, etc. These layers are mainly hydrophilic colloid layers.

Examples of binders for use in the hydrophilic colloid layers include protein such as gelatin, colloidal albumin, and casein; cellulose compounds such as carboxymethyl cellulose and hydroxyethyl cellulose; saccharose derivatives such as agar-agar, sodium alginate and starch derivatives; and synthetic hydrophilic colloid such as polyvinyl alcohol, poly-N-vinylpyrrolidone, polyacrylic acid copolymer, polyacrylamide or derivatives or partially hydrolyzates thereof, dextran, polyvinyl acetate, polyacrylic esters and rosin. If desired, a mixture of two or more of these may be used.

Among them, gelatin and derivatives thereof are most widely used. The term "gelatin" as used herein includes lime-processed gelatin, acid-processed gelatin and enzyme-processed gelatin.

The photographic constituent layers of the photographic material of the present invention may contain the polymer latex described in U.S. Pat. Nos. 3,411,911 and 3,411,912 and JP-B-45-5331.

The silver halide emulsion layers and other hydrophilic colloid layers of the photographic material of the present invention can be hardened by an organic or inorganic hardening agent (singly or in combination). Typical examples of the hardening agent include high-molecular weight hardening agents and low-molecular hardening agents.

Typical examples of preferred types of silver halide color photographic materials of the present invention include reversal color films and negative color films. Particularly preferred color photographic materials in the present invention are general-purpose negative color films.

General-purpose negative color films are illustrated below.

The photographic material of the present invention may comprise a support having thereon at least one blue-sensitive silver halide emulsion layer, at least one green-sensitive silver halide emulsion layer and at least one red-sensitive silver halide emulsion layer. There is no particular limitation with regard to the number of silver halide emulsion layers and non-sensitive layers, and the order of the arrangement of the layers. A typical example is a silver halide photographic material comprising a support having thereon at least one light-sensitive unit layer consisting of a plurality of silver halide emulsion layers having substantially the same color sensitivity, but different light sensitivity. The unit light-sensitive layer can have a color sensitivity to any one of blue light, green light and red light. In multilayer silver halide color photographic materials, the arrangement of the unit light-sensitive layer is generally in order of a red-sensitive layer, green-sensitive layer and blue-sensitive layer with the red-sensitive layer being nearest from the support. However, the arrangement may be made in a reverse order. If desired, between layers having the same color sensitivity may be interposed a light-sensitive layer having a different color sensitivity from that of the above layers.

Non-sensitive layers such as an interlayer may be provided between the sensitive silver halide layers, and/or as the uppermost layer or the lowermost layer.

The interlayer may contain couplers and DIR compounds as described in JP-A-61-43748, JP-A-59-113438, JP-A-59-113440, JP-A-61-20037 and JP-A-61-20038 and color mixing inhibitors as in a conventional photographic material.

The plurality of silver halide emulsion layers which constitute each unit light-sensitive layer are described in West German Patent 1,121,470, U.K. Patent 923,045, JP-A-57-112751, JP-A-62-200350, JP-A-62-206541, JP-A-62-206543, JP-A-56-25738, JP-A-62-63936, JP-A-59-202464, JP-B-55-34932 and JP-B-49-15495.

The silver halide grains for use in the silver halide emulsion layers of the present invention may have a regular crystal form such as a cube, octahedron or tetradecahedron, an irregular crystal form such as a sphere or platy from, a crystal form having a defect such as a twinning plate or composite form of these crystal forms.

The grain size of the silver halide grains may range from fine grains having a grain size of not larger than about 0.2 μm to large-size grains having a grain size of about 10 μm in terms of the diameter of a circle having an area equal to the projected area of the grain. Any of a polydisperse emulsion and a monodisperse emulsion can be used.

The silver halide photographic emulsion of the present invention can be prepared by methods described, for example, in *Research Disclosure* (RD) No. 17643, pages 22 to 23, "I. Emulsion preparation and types" (December 1978), ibid. No. 18716, page 648 (November, 1979), P. Glafkides, *Chemic et phisique Photographic* (Paul Montel 1967), G. F. Duffin, *Photographic Emulsion Chemistry* (Focal Press 1966) and V. L. Zelikman et al., *Making and Coating Photographic Emulsion* (Focal Press 1964).

The monodisperse emulsions described in U.S. Pat. Nos. 3,574,628 and 3,655,394 and U.K. Patent 1,413,748 are also preferred.

Tabular grains having an aspect ration of not lower than about 5 can be used in the present invention. Tabular grains aare readily prepared by methods described in Gutoff, *Photographic Science and Engineering*, Vol. 14, pages 248 to 257 (1970), U.S. Pat. Nos. 4,434,226, 4,414,310, 4,433,048 and 4,439,520 and U.K. Patent 2,112,157.

The crystal structure of the grain may be uniform, or may have a different in halogen composition between the interior of the grain and the surface layer thereof. The crystal structure may be a laminar structure or may be such that a silver halide having a different composition is bonded to the grain by epitaxial growth. The grain may be joined to a compound such as a silver rhodanide or lead oxide other than silver halide.

A mixture of grains having various crystal forms may be used.

Generally, silver halide emulsions are subjected to physical ripening, chemical ripening and spectral sensitization prior to coating. The effect of the present invention is pronounced when emulsions sensitized with a gold compound and a sulfur-containing compound are used. Additives used in such stages are described in *Research Disclosure* No. 17643 and *Research Disclosure*, No. 18716 and as provided in the following Table.

Conventional photographic additives for use in the present invention are listed in the above two *Research Disclosure* publications as indicated and given in the following Table.

| Kind of Additives | RD 17643 | RD 18716 |
|---|---|---|
| 1. Chemical sensitizing agent | Page 23 | Page 648, right column |
| 2. Sensitivity increaser | | Page 648, right column |
| 3. Spectral sensitizing agent, supersensitizing agent | Pages 23 to 24 | Page 648, right column to page 649, right column |
| 4. Brightener | Page 24 | |
| 5. Antifogging agent and stabilizer | Pages 24 to 25 | Page 649, right column |
| 6. Light absorber, filter dye, ultraviolet light absorber | Pages 25 to 26 | Page 649, right column to page 650, left column |
| 7. Antistaining agent | Page 25, right column | Page 650, left column to right column |
| 8. Dye image stabilizer | Page 25 | |
| 9. Hardening agent | Page 26 | Page 651, left column |

-continued

| Kind of Additives | RD 17643 | RD 18716 |
|---|---|---|
| 10. Binder | Page 26 | Page 651, left column |
| 11. Plasticizer, lubricants | Page 27 | Page 650, right column |
| 12. Coating aid, surfactants | Pages 26 to 27 | Page 650, right column |

It is preferred that a compound which fixes formaldehyde as described in U.S. Pat. Nos. 4,411,987 and 4,435,503 is added to the photographic materials to prevent deterioration in photographic performance due to formaldehyde gas.

Various color couplers can be used in the present invention. Specific examples thereof are described in the patent specifications cited in the aforesaid *Research Disclosure* (RD) No. 17643, VII-C to Examples of preferred yellow couplers include the compounds described in U.S. Pat. Nos. 3,933,501, 4,022,620, 4,326,024, 4,401,752 and 4,248,961, JP-B-58-10739, U.K. Patents 1,425,020 and 1,476,760, U.S. Pat. Nos. 3,973,968, 4,314,023 and 4,511,649 and European Patent 249,473A.

5-Pyrazolone compounds and pyrazoloazole compounds are preferred as magenta couplers. The magenta couplers described in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. (June 1984) JP-A-60-43659, JP-A-61-72238, JP-A-60-JP-A-55-118034, JP-A-60-185951, U.S. Pat. Nos. 4,500,630, 4,540,654 and 4,556,630 and WO (PCT) 88/04795 are particularly preferred.

Cyan couplers include phenol couplers and naphthol couplers. Examples of preferred cyan couplers include the compounds described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid-Open No. 3,329,729, European Patents 121,365A and 249,453A, U.S. Pat. Nos. 3,446,622, 4,333,999, 4,753,871, 4,451,559, 4,427,767, 4,690,889, 4,254,212 and 4,296,199 and JP-A-61-42658.

Preferred examples of colored couplers for correcting undesired side absorptions of developed dye images include those described in *Research Disclosure* No. 17643, item VII-G, U.S Pat. No. 4,163,670, JP-B-57-39413, U.S. Pat. Nos. 4,004,929 and 4,138,258 and U.K. Patent 1,146,368.

Preferred examples of couplers, the developed dyes of which are diffusive include those described in U.S. Pat. No. 4,366,237, U.K. Patent 2,125,570, European Patent 96,570 and West German Patent Laid-Open No. 3,234,533.

Typical examples of dye forming polymer couplers for use in the present inventin are described in U.S. Pat. Nos. 3,451,820, 4,080,211, 4,367,282, 4,409,320 and 4,576,910 and U.K. Patent 2,102,173.

Couplers which release a photographically useful residue by coupling are preferably used in the present invention. Preferred examples of DIR couplers which release a development inhibitor include those described in patent specifications cited in the aforesaid *Research Disclosure* No. 17643, item VII-F, JP-A-57-151944, JP-A-57-154234, JP-A-60-184248, JP-A-63-37346 and U.S. Pat. No. 4,248,962.

Preferred examples of couplers which imagewise release a nucleating agent or a development accelerator include those described in U.K. Patents 2,097,140 and 2,131,188, JP-A-59-157638 and JP-A-59-170840.

Examples of other couplers for use in the photographic material of the present invention include competitive couplers as described in U.S. Pat. No. 4,130,427; polyequivalent type couplers as described in U.S. Pat. Nos. 4,283,472, 4,338,393, and 4,310,618; DIR redox compound-releasing couplers, DIR coupler-releasing couplers, DIR coupler-releasing redox compounds described DIR redox-releasing redox compounds as described in JP-A-60-185950 and JP-A-62-24252; couplers which release a dye which is restored to its original color after elimination as described in European Patent 173,302A; bleaching accelerator-releasing couplers as described in JP-A-61-201247; ligand-releasing couplers as described in U.S. Pat. No. 4,553,477; and couplers which release a leuco dye as described in JP-A-63-75747.

The couplers for use in the present invention can be introduced into the photographic material by known dispersion methods.

Examples of high-boiling solvents for use in oil-in-water coupler dispersion methods are described in U.S. Pat. No. 2,322,027.

Specific examples of high-boiling organic solvents having a boiling point of not lower than 175° C. under atmospheric pressure for use in the oil-in-water dispersion method include phthalic esters, phosphoric or phosphonic esters, benzoic esters, amides, alcohols, phenols, aliphatic carboxylic acid esters, aniline derivatives and hydrocarbons. Organic solvents having a boiling point of not lower than about 30° C., preferably not lower than 50° C., but not higher than about 160° C. can be used as an auxiliary solvent. Typical examples of the auxiliary solvents include ethyl acetate, butyl acetate, ethyl propionate, methyl ethyl ketone, cyclohexanone, 2-ethoxyethyl acetate and dimethylformamide.

Specific examples of latex dispersion methods and loadable latex methods are described in U.S. Pat. No. 4,199,363 and West German Patent Application (OLS) Nos. 2,541,274 and 2,541,230.

The sum total thicknesses of all of the hydrophilic colloid layers on the photosensitive emulsion layer side of the support of the photographic material of the present invention is preferably not larger than 28 μm and the layer-swelling rate $T_{\frac{1}{2}}$ is preferably not longer than 30 seconds. The layer thickness as used hererin is the layer thickness measured after moisture conditioning at 25° C. and 55% RH for 2 days. The layer-swelling rate $T_{\frac{1}{2}}$ can be measured by known methods in the art. For example, the layer-swelling rate can be measured by using a swellometer of a type described in A. Green, *Photographic Science and Engineering*, Vol. 19, No. 2, pages 124–129. The layer-swelling ration $T_{\frac{1}{2}}$ is defined as the time elapsed until the layer thickness reaches ½ of the saturated swollen layer thickness. The saturated swollen layer thickness is difined as 90% of the maximum swollen layer thickness reached when processed in a color developing solution at 30° C. for 3¼ minutes.

The layer-swelling rate $T_{\frac{1}{2}}$ can be controlled by adding a hardening agent to gelatin used as a binder, or by ageing the photographic material after coating. The swelling ratio is preferably 150 to 400%. The swelling ration can be calculated form the maximum swollen layer thickness under the above-described conditions.

Swelling ratio=(maximum swollen layer thickness−layer thickness)/layer thickness The color photographic material of the present invention can be developed by the general methods described in the aforesaid *Research Disclosure* No. 17643, pages 28–39 and *Research Disclosure* No. 18716, page 615 (left to right columns).

The silver halide color photographic material of the present invention may contain a color developing agent to simplify and expedite processing. It is preferred that a precursor of the developing agent is incorporated into the photographic material. Examples of the precursors include indoaniline compounds as described in U.S. Pat. No. 3,342,597, schiff base type compounds as described in U.S. Pat. No. 3,342,599, *Research Disclosure* No. 14850 and *Research Disclosure* No. 15159 and the compounds as described in *Research Disclosure* No. 13924.

The silver halide photographic material of the present invention comprises a support having thereon at least one light-sensitive silver halide emulsion layer and at least one transparent magnetic recording layer. The light-sensitive silver halide emulsion layer and the magnetic recording layer may be provided on the same side of the support or on the different sides thereof (e.g., both layers may be separately provided on any one side of the support). If desired, the magnetic recording layer may be incorporated into the interior of the support.

When the light-sensitive silver halide emulsion layer and the magnetic recording layer are provided on the same side of the support, the light-sensitive silver halide emulsion layer may be provided between the support and the magnetic recording layer, or on the outer side of the magnetic recording layer. One or more layer may be provided between the light-sensitive silver halide emulsion layer and the magnetic recording layer, or no layer need be provided therebetween. The light-sensitive silver halide emulsion layer and the magnetic recording layer may constitute the same layer. One or more layers may be provided on any one layer of the light-sensitive silver halide emulsion layer and the magnetic recording layer, said any one layer being farther away from the support. No layer may be provided thereon.

A roll-form film is a preferred form of the photographic material of the present invention, because the recording of signals onto the transparent magnetic recording layer during the conveying of the film in a camera or printer is readily accomplished. It is preferred that in the roll film, the area of one frame of the exposure area of an image is not smaller than 350 $mm^2$, but not larger than 1200 $mm^2$, and the magnetic information-recordable space is not smaller than 15% of the area of one frame of the exposure area of an image. Specifically, in order to provide sufficient area for magnetic recording, it is preferred that the number of perforations per one picture is not more than 135 formats. It is particularly preferred that the number of perforations per one frame is not more than 4.

Optical information can be also be reached onto a magnetic information-recordable space using a light-emitting device such as an LED. It is also preferred that magnetic information and optical information in a superposed form are recorded onto this space. Magnetic recording formats according to the system disclosed in WO (PCT) 90-04205 are preferred.

When the photographic material of the present invention is used in the form of a roll, the roll is preferably housed in a cartridge. The most widely used cartridge is a patrone having the 135 format. Other examples of usable cartridges include those described in JP-A-U-58-67329 (the term "JP-A-U" as used herein means an "unexamined published Japanese Utility model application"), JP-A-58-181035, JP-A-58-182634, JP-A-U-58-195236, U.S. Pat. No. 4,221,479, JP-A-1-231045, 2-170156, 2-205843, 2-210346, 2-199451, 2-201441, 2-214853, 2-211443, 2-264248, 3-37646, 3-37645 and 2-124564, Japanese Patent Application Nos., 63-183344 and 1-21862, and U.S. Pat. Nos. 4,846,418, 4,848,693 and 4,832,275.

Cartridges having an altitude controlling device for cartridge are particularly preferred (see, Japanese Patent Application No. 1-214895).

The present invention is now illustrated in greater detail by reference to the following examples which, however, are not to be construed as limiting the invention in any way.

EXAMPLE 1

A cellulose triacetate dope solution containing barium ferrite (hexagonal platy particles having a thickness of 0.02 μm and a particle size of 0.1 μm) dispersed therein and a cellulose triacetate dope solution were co-cast to prepare a film having a transparent magnetic recording layer of 2 μm in thickness (total thickness of film 122 m). Before the magnetic layer was dried, the film was treated with a cobalt magnet (2000 Gauss) to thereby orientate the magnetic substance. The coating weight of barium ferrite was 0.14 $g/m^2$. The resulting sample was referred to as sample A.

A sample containing γ-iron oxide (needle particles, specific surface area: 32 $m^2/g$, particle size: 0.23 μm) as the magnetic substance was referred to as sample B. Furthermore, a sample containing Co-containing γ-iron (III) oxide (needle particles, specific surface area: 38 $m^2/g$, particle size: 0.20 μm), a sample containing $CrO_2$ (particle size: 0.15 μm) and a sample containing a metallic iron magnetic substance (needle particles specific surface area: 50 $m^2/g$, particle size: 0.12 μm) were referred to as sample C, sample D and sample E, respectively. Each of the samples B to E was co-cast in the same manner as described above to prepare each sample in the form of a film.

In the same manner as in the preparation of the sample A, a sample F and a sample G were prepared except that the coating weights of barium ferrite were 0.4 $g/m^2$ and 0.004 $g/m^2$, respectively.

The transmitted density of each of the samples A to G and the 122 μm thick cellulose triacetate film containing no magnetic substance was measured by using X-RITE status A manufactured by X-RITE, and the optical density was measured through B, G and R filters. A transmitted average density and a degree of gray were calculated from the difference in optical density between each of the samples A and G and the 122 μm thick cellulose triacetate film having no magnetic recording layer, that is, from the optical density of a portion of the 2 μm thick magnetic recording density. The results are shown in Table 1.

It is considered herein that when the transmitted average density is not higher than 0.5, the magnetic recording layer is transparent and photographic characteristics are not adversely affected thereby.

It is apparent from Table 1 that when barium ferrite is used, the transmitted average density is not higher than 0.5, and the degree of gray is not lower than 70%.

Sine wave signals of 1 KHz were recorded onto the samples A to G by using a coinventional audio head, and the reproduction of the signals was accomplished using the same head. The output signals were evaluated. The relative velocity of the film and the head during recording and reproduction was 4.76 cm/s. The evaluation was made in the following manner.

The mark A in the column of magnetic characteristics of Table 1 indicates that the reproduced signal was satisfactorily read.

The mark B indicates that reproduced signal could not be read.

The results are shown in Table 1.

It is apparent from Table 1 that the samples excepting sample B enabled magnetic input and output (recording and reproduction) to be carried out.

The reversal color photographic emulsion layers of the sample 101 described in Example 1 of JP-A-2-854 were coated onto the side of the support of the samples A to G opposite that having the magnetic substance layer. A sample having photographic layers coated thereon but no magnetic substance layer was prepared and referred to as sample H.

The sample H was gray-exposed to give a R density of 0.8 and processed. The samples A to G were exposed under the same filter conditions to give a R density of 0.8 and processed. The development was carried out according to the method described in Example 1 of JP-A-2-854.

The transmitted density of each of the resulting samples was measured by using X-RITE status A manufactured by X-RITE. The value of the difference in density between each of the samples A to G and the sample H is shown in Table 1. The sensitivity in terms of relative sensitivity is also shown in Table 1 when the sensitivity of the sample H to red was given as 100.

It is clear from Table 1 that the samples A, F and G of the present invention have transparency of substantially neutral gray, while the color balance of the comparative samples is greatly deteriorated and photographic performance is not satisfactory.

TABLE 1

| Sample | Ferromagnetic substance powder type | Coating weight ($g/m^2$) | Transmitted average density | Degree of gray (%) | Photographic characteristics after coating photographic emulsions $\Delta D^B$ | $\Delta D^G$ | $\Delta D^R$ | relative sensitivity | Magnetic characteristics | Remarks |
|---|---|---|---|---|---|---|---|---|---|---|
| A | barium ferrite | 0.14 | 0.06 | 80 | 0.01 | 0.01 | 0.01 | 98 | A | Invention |
| B | γ-iron oxide | 0.14 | 0.15 | 50 | 0.10 | 0.05 | 0.03 | 90 | B | Comp. Ex. |
| C | Co-containing γ-iro (III) oxide | 0.14 | 0.10 | 65 | 0.06 | 0.03 | 0.02 | 95 | A | " |
| D | $CrO_2$ | 0.14 | 0.12 | 60 | 0.05 | 0.03 | 0.02 | 96 | A | " |
| E | metal | 0.14 | 0.08 | 65 | 0.06 | 0.04 | 0.02 | 98 | A | " |
| F | barium ferrite | 0.40 | 0.50 | 80 | 0.20 | 0.20 | 0.19 | 96 | A | Invention |
| G | barium | 0.004 | 0.01 | 80 | 0.00 | 0.00 | 0.00 | 99 | A | " |

EXAMPLE 2

Barium ferrite particles (hexagonal platy particles, thickness: 0.02 μm, particle size: 0.1 μm) were dispersed in water to prepare a 10 wt % dispersion. 100 g of the dispersion was mixed with 125 g of a 8 wt % aqueous solution of gelatin and the mixture was finely dispersed. The resulting dispersion was coated on the entire surface of the back side of a cellulose triacetate film to provide a layer (0.3 μm thickness) having a coating weight of 0.14 $g/m^2$ of barium ferrite. While the coated magnetic layer was still in a wet state, the magnetic layer was orientated using a cobalt magnet (2000 Gauss). The thus-obtained film was referred to as sample I.

A sample containing γ-iron oxide (needle particles, specific surface area: 32 $m^2$/ g, particle size: 0.23 μm) as the magnetic substance was referred to as sample J. Furthermore, a sample containing Co-containing γ-iron (III) oxide (needle particle, specific surface area: 38 $m^2$/ g, particle size; 0.20 μm), a sample containing $CrO_2$ (particle size; 0.15 μm) and a sample containing metallic iron as the magnetic substance (needle particles, specific surface area: 50 $m^2$/ g, particle size; 0.12 μm) were referred to as sample K, sample L and sample M, respectively. The samples I to M were dispersed in an aqueous gelatin solution in the same manner as described above to prepare each sample in the form of a film.

The optical density and magnetic characteristics of each of the samples I to M were measured in the same manner as in Example 1.

Even when the samples were prepared by dispersing them in an aqueous gelatin solution, the same optical density and magnetic characteristics as in Example 1 were obtained. It was found that the sample I of the present invention had good optical density as well as good magnetic characteristics. The sample J was inferior in magnetic characteristics. The samples K, L and M had good magnetic characteristics, but were inferior in optical density to the sample of the present invention.

EXAMPLE 3

A cellulose triacetate dope solution containing barium ferrite particles (hexagonal platy particles, thickness: 0.02 μm) dispersed therein and a collulose triacetate dope solution were co-cast to prepare a film having a transparent magnetic recording layer of 2 μm in thickness (total thickness of film: 122 μm). Before the magnetic layer was dried, the film was treated with a cobalt magnet (2000 Gauss) to orientate the magnetic substance. The coating weight of barium ferrite was 0.14 $g/m^2$. The resulting sample to as sample N.

A sample containing barium ferrite (hexagonal platy particles, thickness: 0.05 μm), a sample containing barium ferrite (hexagonal platy particles, thickness: 0.07 μm), a sample containing barium ferrite (hexagonal platy particles, thickness 0.01 μm) and a sample containing barium ferrite (amorphous particles prepared by crushing large-size particles, average particle diameter: 0.1 μm) were referred to as sample S, sample O, sample P and sample Q. Other preparation conditions were the same as those described in Example 1 above.

The optical density and magnetic characteristics of each of these samples were measured in the same manner as in Example 1. The results are shown in Table 2.

TABLE 2

| Sample | Ferromagnetic substance powder: Barium ferrite | Thickness (average particle size) (μm) | Transmitted coating weight (g/m²) | Average density | Degree of gray (%) | Photographic characteristics after coating photographic emulsions: $\Delta D^B$ | $\Delta D^G$ | $\Delta D^R$ | Relative sensitivity | Magnetic characteristics | Remarks |
|---|---|---|---|---|---|---|---|---|---|---|---|
| N | hexagonal platy form | 0.02 (0.1) | 0.14 | 0.06 | 85 | 0.01 | 0.01 | 0.01 | 97 | A | Invention |
| O | hexagonal platy form | 0.05 (0.25) | 0.14 | 0.07 | 70 | 0.02 | 0.02 | 0.02 | 94 | A | " |
| P | hexagonal platy form | 0.07 (0.35) | 0.14 | 0.09 | 67 | 0.04 | 0.03 | 0.01 | 90 | A | Comp. Ex. |
| Q | hexagonal platy form | 0.01 (0.05) | 0.14 | 0.05 | 90 | 0.01 | 0.01 | 0.01 | 98 | A | Invention |
| R | amorphous | 0.1 (0.1) | 0.14 | 0.15 | 55 | 0.10 | 0.07 | 0.04 | 90 | B | Comp. Ex. |

It is clearly seen that samples having a transmitted average density of not higher than 0.50, a degree of gray of not lower than 70% and good magnetic characteristics are only the samples N, O and Q of the present invention.

It is clearly seen from the above disclosure that the silver halide photographic materials having a transparent magnetic recording layer of the present invention provides a photographic material which can be used to record information during photographing, information relating to processing in laboratories after photographing and output information to TV and video. Furthermore, the magnetic recording layer of the present invention does not adversely effect photographic characteristics, particularly, color balance out of order.

While the present invention has been described in detail and with reference to specific embodiments thereof, it is apparent to one skilled in the art that various changes and modifications can be made therein without departing from the spirit and the scope of the present invention.

What is claimed is:

1. A silver halide photographic material comprising a support having provided thereon at least one light-sensitive silver halide emulsion layer and at least one transparent magnetic recording layer, wherein the magnetic recording layer consists essentially of a binder and hexagonal platy barium ferrite magnetic particles and has a degree of gray of at least 70%.

2. A silver halide photographic material as in claim 1, wherein the hexagonal platy barium ferrite magnetic particles have a thickness of from 0.002 to 0.05 μm.

3. A silver halide photographic material as in claim 1, wherein the photographic material is a color photographic material.

4. A silver halide photographic material as in claim 1, wherein the transmitted average density of the magnetic recording layer is 0.5 or less.

5. A silver halide photographic material as in claim 1, wherein the aspect ratio of the hexagonal platy barium ferrite magnetic particles is from 2.5 to 10.

6. A silver halide photographic material as in claim 1, wherein the hexagonal platy barium ferrite magnetic particles are contained in the magnetic recording layer in an amount of from $4\times10^{-4}$ to 3 g per m² of the support.

7. A silver halide photographic material as in claim 1, wherein the weight ratio of the hexagonal platy barium ferrite magnetic particles to the binder in the magnetic recording layer is from 2:1 to 1:100.

8. A silver halide photographic material as in claim 1, wherein the magnetic recording layer is established on the side of the support opposite to that having thereon the light-sensitive silver halilde emulaion layer.

* * * * *